US006842924B1

(12) United States Patent
Walters

(10) Patent No.: US 6,842,924 B1
(45) Date of Patent: Jan. 18, 2005

(54) SURGICAL HEAD REST

(75) Inventor: Matthew K. Walters, Chesterfield, MO (US)

(73) Assignee: Omni Therm, Inc., St. Louis, MO (US)

( * ) Notice: Subject to any disclaimer, the term of this patent is extended or adjusted under 35 U.S.C. 154(b) by 0 days.

(21) Appl. No.: 10/444,831

(22) Filed: May 23, 2003

(51) Int. Cl.[7] ..... A47C 20/02
(52) U.S. Cl. ..... 5/637; 5/636; 5/638; D6/601
(58) Field of Search ..... 5/636–639; D6/601

(56) References Cited

U.S. PATENT DOCUMENTS

| | | | | |
|---|---|---|---|---|
| 2,688,142 | A | 9/1954 | Jensen | 5/338 |
| 3,366,106 | A | 1/1968 | Yao et al. | 128/76 |
| 3,694,831 | A | 10/1972 | Treace | 5/338 |
| D271,834 | S | 12/1983 | Huntsinger | D6/201 |
| 4,752,064 | A | 6/1988 | Voss | 269/328 |
| D298,992 | S | 12/1988 | Voss | D6/601 |
| D337,914 | S | 8/1993 | McDonald | D6/601 |
| 5,269,035 | A | 12/1993 | Hartunian | 5/638 |
| 5,613,501 | A | 3/1997 | Michelson | 128/846 |
| D414,974 | S | 10/1999 | Marrone, II et al. | D6/601 |
| 5,960,494 | A | 10/1999 | Gilliland et al. | 5/638 |
| D456,516 | S | 4/2002 | Cheshaek et al. | D24/183 |
| 6,374,441 | B1 | 4/2002 | Begell | 5/638 |
| 6,427,272 | B1 | 8/2002 | Yacoub | 5/638 |
| 6,490,737 | B1 | 12/2002 | Mazzei et al. | 2/410 |

*Primary Examiner*—Teri Pham Luu
(74) *Attorney, Agent, or Firm*—Grace J. Fishel

(57) ABSTRACT

A unitary support for holding and cushioning the head and face of a surgical patient has a resilient body of molded foam. The resilient body has a cavity formed in the upper face for receiving and cushioning the head and face of a patient. The resilient body has access openings therein for additional apparatus, such as an endotracheal tube, and to permit viewing of the patient's face during surgery. The resilient body has stiffening structure to prevent constriction of the openings during use and to prevent constriction of an endotracheal tube or similar apparatus.

20 Claims, 4 Drawing Sheets

SURGICAL HEAD REST

BACKGROUND OF THE INVENTION

1. Field of the Invention

The present invention relates to a head rest for supporting the head of an anesthetized patient in prone position during surgery.

2. Brief Description of the Prior Art

Some surgical procedures are performed on an anesthetized patient in a face down, prone, position with breathing supported by an endotracheal tube placed in the patient's mouth. In this position much of the weight of the patient's head must be supported on the soft tissue of the face. The art has provided a number of structures to support a patient's head in this position. These structures, however, either obstruct much of the view of the patient's face making it more difficult to monitor the patient or limit access to the endotracheal tube which may make the condition of the endotracheal tube more difficult to watch.

In addition, the supporting structure typically used for head rests is made of a cushioning material or includes a cushioning material. Since the cushioning material is soft, it collapses or partially collapses under the weight of the patient's head. The change of shape of the supporting structure may further block the view of the patient's face or pinch off the endotracheal tube.

U.S. Pat. Nos. D 271,834, D 298,992, D 337,914, D 414,974, D 456,516, 2,688,142, 3,366,104, 3,694,831, 4,752,064, 5,269,035, 5,613,501, 5,960,494, 6,374,441, 6,427,272, and 6,490,737 are incorporated by reference herein.

BRIEF SUMMARY OF THE INVENTION

The present invention provides an inexpensive structure for supporting the head of a patient during surgery. The structure is unitary and freestanding. The structure may be formed of inexpensive materials, such as a molded foam. The support structure is suited for single use application, which reduces the chance of infection.

The head rest provides a cushioning support which minimizes stress on the head of the patient. The cushioning movement of the head rest under the weight of the patient's head is controlled by the structure of the head rest in a manner that the view of the patient's face remains unobstructed and the head rest does not interfere with the endotracheal tube or such other apparatus that may be attached to the patient.

It is thus an object of the present invention to provide a unitary head rest which provides a cushioning support for a patient's head during surgery. It is a further object to provide a head rest that does not obscure the view of the patient's face or pinch off the breathing support. Another object is to provide a single use, inexpensive head rest for use in surgery.

These and other objects will be apparent from the Drawings and from the following Description of the Drawings and the Description of the Preferred Embodiments.

BRIEF DESCRIPTION OF THE SEVERAL VIEWS OF THE DRAWING

In the accompanying drawings, in which one of various possible embodiments of the invention are illustrated, corresponding reference characters refer to corresponding parts throughout the several views of the drawings in which.

DETAILED DESCRIPTION OF THE INVENTION

Figure 1:
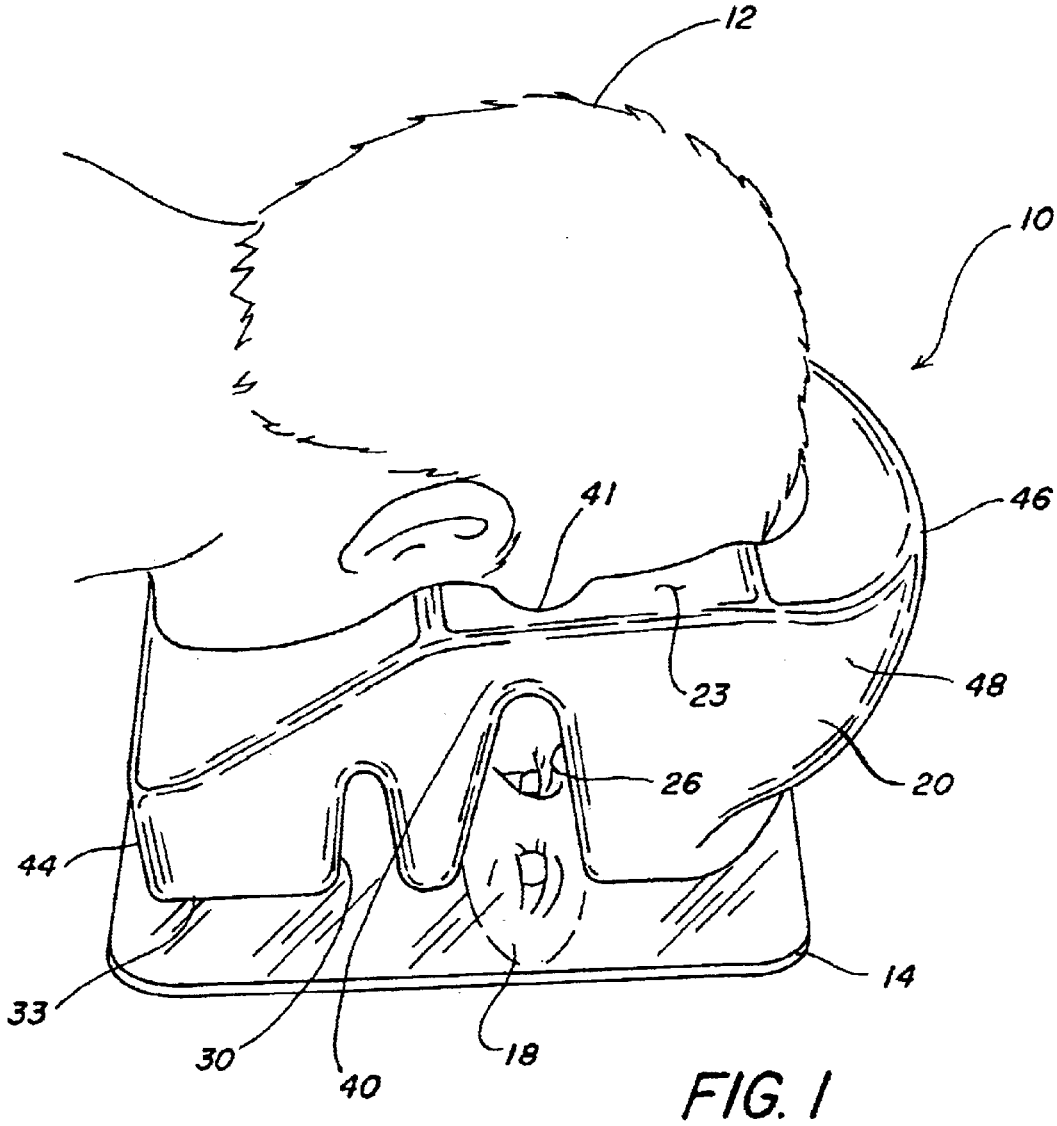
FIG. 1 is a perspective view of the device of the invention supporting the head of a patient.
Figure 2:
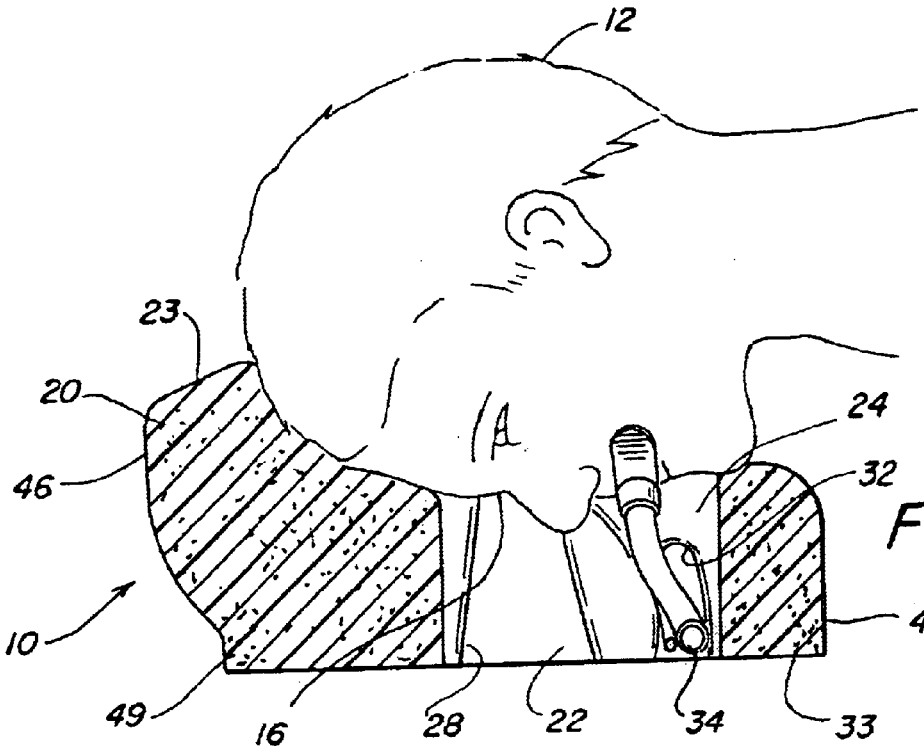
FIG. 2 is a left side view of FIG. 1 in partial cross-section.
Figure 3:
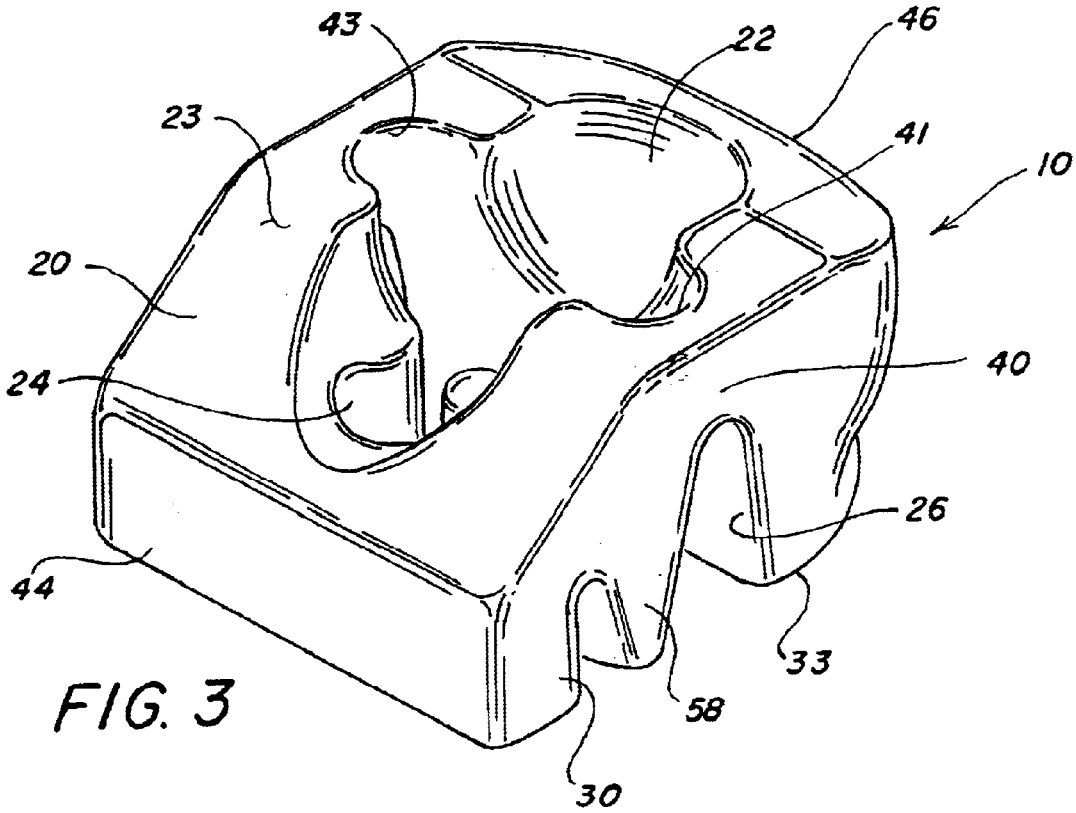
FIG. 3 is a perspective view of the device of the invention.

Referring to FIG. 1, a cushioning device of the invention 10 is shown supporting a head 12 of a patient. The patient is in the face down, prone position, as shown. Cushioning device 10 is placed over a mirror 14, which permits a face 16 of the patient to be observed as a reflection 18.

Cushioning device 10 has a body 20 formed of a resilient cushioning material, as described herein. Cushioning device 10 has a central cavity 22 in an upper face 23 of body 20 as shown in FIGS. 2 through 7. Head 12 is received in central cavity 22 and supported by cushioning device 10 along the patient's forehead, as shown. Body 20 of cushioning device 10 also has a longitudinally spaced cavity 24, as shown in FIGS. 2, 3, 4, 6 and 7, for support of the patient's cheeks and chin. A slot 25, into which the nose of the patient is received, joins longitudinally spaced cavity 24 with central cavity 22.

Cushioning device 10 also has a plurality of transverse passages 26, 28, 30 and 32 in a lower face 33 of body 20. Transverse passages 26 and 28 communicate with the central cavity 22 and allow face 16 of the patient to be observed in mirror 14. Transverse passages 30 and 32 communicate with longitudinally spaced cavity 24 and allow an endotracheal tube 34 to be monitored.

Transverse passages 26 and 28 are positioned near a transverse axis of body 20, as shown. Transverse passages 26 and 28 are preferable formed as tapered arches and extend from lower face 33 of body 20 to near upper face 23 of body 20. The height and shape of transverse passages 26 and 28 form hinge points 40 and 42 in body 20 of cushioning device 10, as described herein.

Transverse passages 30 and 32 are positioned between the transverse passages 26 and 28 and a proximal end 44 of body 20 of cushioning device 10. Transverse passages 30 and 32 are also preferably formed as tapered arches and extend toward the upper face 23 of body 20. Transverse passages 30 and 32 terminate at a greater distance from upper face 23 of body 20 than transverse passages 26 and 28, leaving a greater volume of material between the termination points of transverse passages 30 and 32 and upper face 23 of body 20 than transverse passages 26 and 28. The greater volume of material created makes this portion of cushioning device stiffer than hinge points 40 and 42 formed by transverse passages 26 and 28. If desired, hinge points 40 and 42 may be made even more flexible by forming relieved areas 41 and 43 adjacent hinge points 40 and 42, as shown.

A distal end 46 of body 20 is formed with a volume of increased material or bulge 48, as shown, with a squared foot 49. Bulge 48 may extend around distal end 46 of body 20 in a curve, as shown and may terminate above bottom face 33 of body 20, also as shown. The increased material of bulge **48*i* increases the stiffness of body 20 at its distal end 46**, as described herein.

Figure 7:
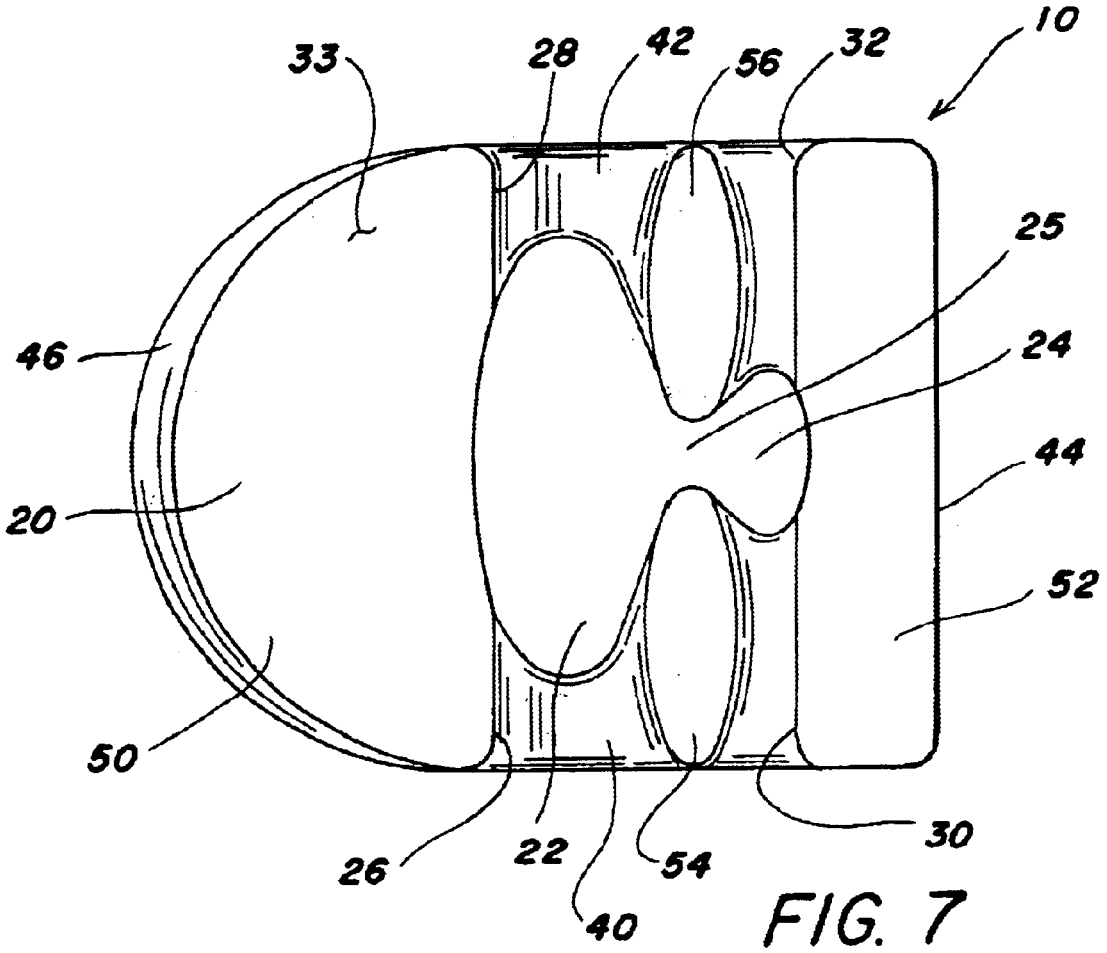

Bottom face 33 of body 20 has a plurality of support surfaces 50, 52, 54 and 56, as shown in FIG. 7. Support surfaces 50, 52, 54 and 56 contact mirror 14, as shown in FIG. 1, or any other supporting structure. Support surface 50 is at distal end 46 of body 20 and support surface 52 is at proximal end 44 of body 20.

Figure 5:
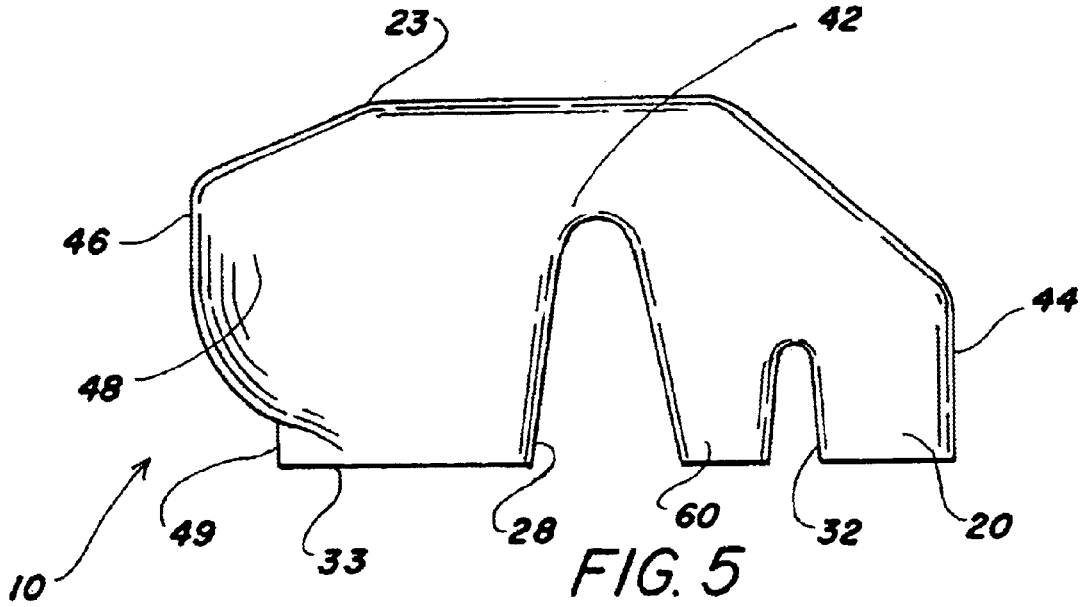
FIG. 5 is a left side view of the device of the invention.
Figure 6:
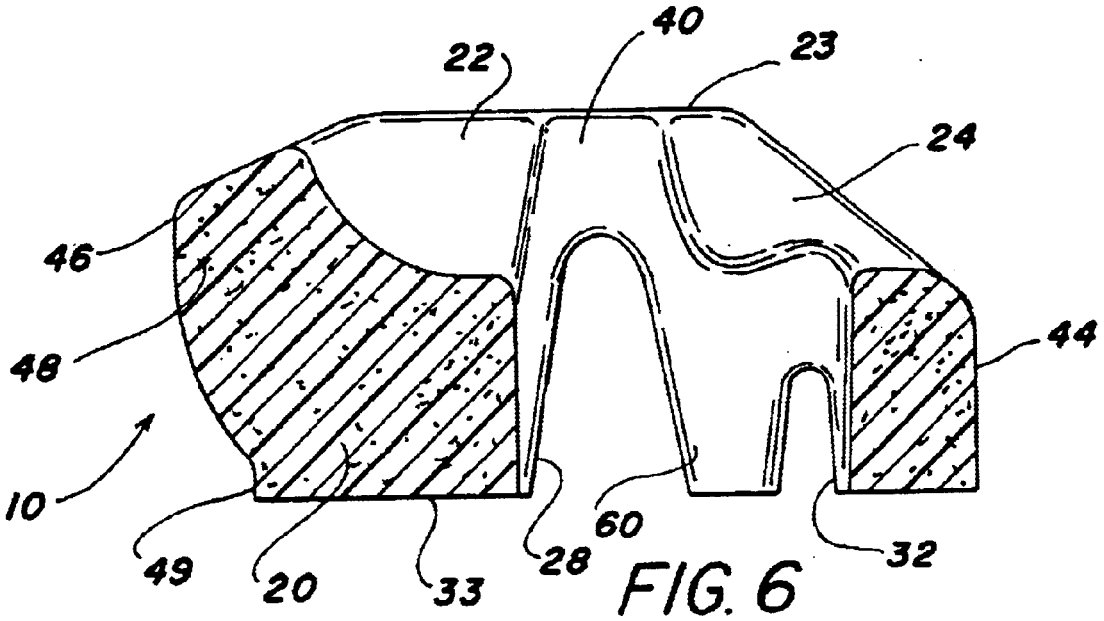
FIG. 6 is a cross-sectional view of the device of the invention taken along the plane 6—6 in FIG. 4; and, FIG. 7 is a bottom view of the device of the invention.

Support surfaces 54 and 56 are positioned centrally in body 20, as shown. Support surfaces 54 and 56 separate transverse passages 26 and 28 from transverse passages 30 and 32. Support surfaces 54 and 56 are separated by slot 25 and form elongated pillars 58 and 60, as shown in FIGS. 1 and 5. Separated pillars 58 and 60 act as independent spring supports which may add to the stability of cushioning device 10.

Cushioning device 10 of the invention is unitary and free standing. Cushioning device 10 of the invention does not require an additional case or support. Cushioning device 10 of the invention is preferably made of an expanded polymer foam, for example, a polyurethane foam. It will be appreciated that other polymer foams may also be used, such as polyether foams, polyester foams, and the like. A blown polyurethane foam having an open cell structure is most preferred. The hardness of the foam is preferably between about 20 to 40 Shore 000 durometer. The optimum durometer is believed to be about 35 Shore 000. This hardness provides optimum support for the head of a patient. The cushioning device 10 is sufficiently stiff that pressure points on a patient's face are minimized, but the cushioning device 10 is sufficiently stiff that the weight of a patient's head does not collapse cushioning device 10 to the point of constricting endotracheal tube 34.

Figure 4:
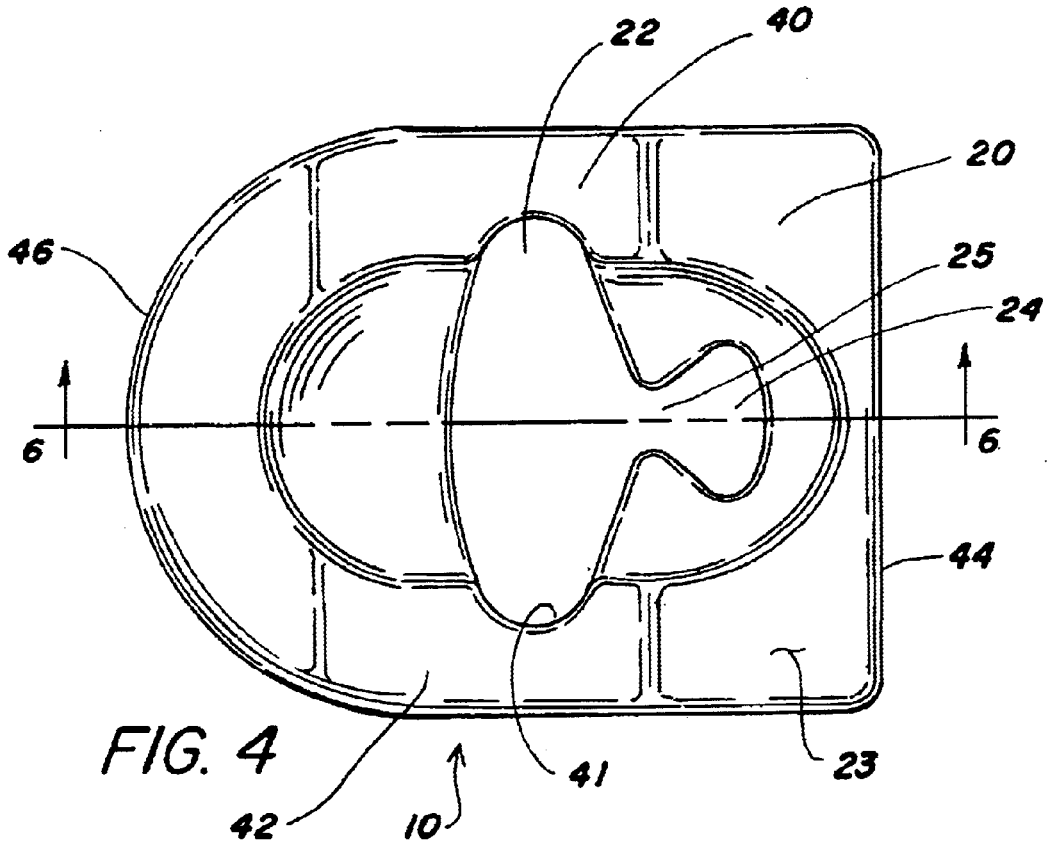
FIG. 4 is a top plan view of the device of the invention.

Cushioning device 10 of the invention may be made by conventional molding techniques using molds which form a pattern for cushioning device 10, as is known in the art. The molds may be heated to form an integral skin on the outer surface of the cushioning device 10, also as is known in the art, but it is preferred to leave the cushioning device 10 unskinned as the unskinned cushioning device 10 is softer and more comfortable for the face of a patient. As shown in FIGS. 4 and 5, for example, cushioning device 10 is formed with smooth, rounded contours. The rounded contours provide a smoother cushioning to face 16 of a patient and facilitate the removal of cushioning device 10 from a mold, as is known in the art. Cushioning device 10, as so formed, is an inexpensive item which may be disposed of after a single use. Device 10 is easily sterilized and as a single use item assists in maintaining a clean environment for surgery.

As noted above, cushioning device 10 is stable and self supporting. No additional structure is required to assist in supporting head 12 of a patient and as a result, there is a softer support for the patient's head 12. A patient's face 16 is highly vascularized and is usually not weight bearing. The softer support provided by cushioning device 10 results in less bruising and other trauma to the patient's head 12, as may result during a long surgery.

The structure of cushioning device 10 maintains the stability of the supported head 12 of a patient. When cushioning device 10 is compressed by the weight of patient's head 12, the access to endotracheal tube 34 remains uncompressed. In particular, the stiff support provided by distal end 46 and proximal end 44 in combination with the softer hinge points 40 and 42 provide a controlled cushioning which results in a neutral or outward pivoting force at the base of transverse passages 26 and 28 and counteracts any tendency to constrict transverse passages 26 and 28. Cushioning device 10 may also be used with a variety of surgical mirrors; no special cooperation between the surgical mirror and cushioning device 10 is required. With any mirror, the view of patient's face 16, and reflection 18 in mirror 14, remain unobstructed. Cushioning device 10 and endotracheal tube 34 are installed before surgery. Cushioning device 10 facilitates the transfer of the patient from a gurney, where the patient is back down, to the face down position for surgery. Mirror 14 can be installed under cushioning device 10 as the patient is turned.

Further, the support provided by proximal end 44 and pillars 58 and 60 resists any tendency to constrict longitudinally extending cavity 24 and transverse passages 30 and 32 or to pinch off endotracheal tube 34 installed therein. The separation of pillars 58 and 60 allows the nose of the patient to clear central cavity 22 and longitudinally extending cavity 24. The wide supporting surfaces 54 and 56 allow pillars 58 and 60 to independently support face 16 of a patient providing additional support and comfort for the patient.

The structure of cushioning device 10 of the invention also provides additional stability in that the cushioning effect is uniform. That is, the compressing motion of patient's head 12 is essentially uniformly vertical. Stiff bulge structure 48 functions to prevent distal end 46 of cushioning device 10 from rolling forward or compressing downward to a greater degree than the central portion or proximal end 44 of body 20, i.e. bulge 48 prevents distal end 46 from buckling forward. This feature helps cushioning device 10 maintain transverse passages 26, 28, 30 and 32 open and unobstructed. The view of patient's face 16 is unobstructed and binding of endotracheal tube 34 is prevented. By preventing binding of endotracheal tube 34 cushioning device 10 prevents chaffing of the patient's mouth from torque being applied to endotracheal tube 34.

It will be appreciated by those skilled in the art that the embodiments disclosed herein are illustrative. The invention disclosed may be modified further without departing from the spirit of the invention. The invention is not to be restricted to the specifics of the structure disclosed herein, but is to be limited only by the scope of the appended claims and their equivalents.

What is claimed:

1. A support for cushioning and holding a patient's head during surgery comprising a resilient body having a cavity formed in an upper face thereof to receive the head and face of a patient placed in a face down position, the resilient body having a plurality of passages therein providing access to the head and face of a patient, the passages extending from a bottom face of the resilient body to near a top face of the resilient body, the passages having the shape of elongated arches, the elongated arches terminating near the top face of the resilient body, the resilient body having a hinge structure to hinge the resilient body and resist constriction of the passages, the hinge structure being adjacent to the upper terminus of the passages, the resilient body having a proximal end and a distal end, the distal end of the resilient body having a stiffening structure to maintain the support of the distal end of the resilient body and resist buckling of the distal end of the resilient body, whereby the support can receive and cushion the head and face of a patient during surgery and hold the head in a stable condition.

2. The device of claim 1 wherein the device is constructed of a molded foamed plastic material.

3. The device of claim 2 wherein the foamed plastic material is a blown polyurethane foam.

4. The device of claim 3 wherein the polyurethane foam is an open celled foam.

5. The device of claim 3 wherein the polyurethane foam is unskinned.

6. The device of claim 1 wherein the resilient body has a hardness of between about 20 and 40 on the Shore 000 scale.

7. The device of claim 6 wherein the Shore 000 hardness is about 35.

8. The device of claim 1 wherein the passages include a first set of passages communicating with a portion of the cavity, the first set of passages providing access for an endotracheal tube.

9. The device of claim 8 wherein the passages include a second set of passages communicating with a portion of the cavity, the second set of passages providing access to view the face of a patient received in the device.

10. The device of claim 1 wherein the stiffening structure includes a bulged volume of foamed material at the distal end of the cushioning device, the bulged volume of foamed material increasing the resistance of the distal end of the cushioning device to compression.

11. The device of claim 10 wherein the bulged volume of foamed material terminates in a squared toot at the base of the distal end of the cushioning device.

12. A support for cushioning and holding the head of a patient during surgery comprising a resilient body having first and second cavities formed in an upper face thereof, the first and second cavities communicating and cooperating to receive the head and face of a patient placed in a face down position, the resilient body having a plurality of passages therein providing access to the head and face of a patient, the passages extending from a bottom face of the resilient body to near a top face of the resilient body, the passages having the shape of elongated arches, the elongated arches terminating near the top face of the resilient body, the passages including a first set of passages providing access to an endotracheal tube when installed on a patient, the passages including a second set of passages providing access to a patient's face, the resilient body having a hinge structure to hinge the resilient body and resist constriction of the passages, the hinge structure being adjacent to the upper terminus of the passages, the resilient body having a proximal end and a distal end, the distal end of the resilient body having a stiffening structure to maintain the support of the distal end of the resilient body and resist buckling of the distal end of the resilient body, the stiffening structure including an increased volume of resilient material at the distal end of the support, whereby the support can receive and cushion the head and face of a patient during surgery and hold the head in a stable condition.

13. The device of claim 12 wherein the resilient body is constructed of a molded foamed plastic material.

14. The device of claim 13 wherein the foamed plastic material is a blown polyurethane foam.

15. The device of claim 14 wherein the polyurethane foam is an open celled foam.

16. The device of claim 14 wherein the polyurethane foam is unskinned.

17. The device of claim 12 wherein the resilient body has a hardness of between about 20 and 40 on the Shore 000 scale.

18. The device of claim 17 wherein the Shore 000 hardness is about 35.

19. A support for cushioning and holding the head of a patient during surgery comprising a free standing resilient body having fa cavity formed in an upper face for receiving and holding the head of a patient in a face down position, the resilient body having a plurality of passages therein for providing access through the resilient body to monitor and view the face of a patient received therein, the passages extending from a bottom face of the resilient body to near the top face thereof, the passages having the shape of elongated arches, the elongated arches terminating near the top face of the resilient body, the resilient body having a hinge structure to hinge the resilient body and resist constriction of the passages, the passages providing access to an endotracheal tube installed on a patient, the resilient body having a distal end with a bulge providing means therein for controlling the compression movement of the resilient body to a substantially vertical movement, whereby the resilient body is self-supporting and remains stable when supporting a patient during surgery.

20. The device of claim 19 wherein the resilient body is constructed of a blown open celled polyurethane foam having a durometer hardness of about 35 on the Shore 000 hardness scale.

* * * * *